US011938588B2

(12) United States Patent
Chen et al.

(10) Patent No.: US 11,938,588 B2
(45) Date of Patent: Mar. 26, 2024

(54) CONTROL METHOD OF GRINDING WATER FLOW RATE DURING DOUBLE SIDE GRINDING PROCESS

(71) Applicant: ZHONGHUAN ADVANCED SEMICONDUCTOR MATERIALS CO., LTD., Jiangsu (CN)

(72) Inventors: Chien-Ming Chen, Taiwan (CN); Kin Peng Low, Lorong (SG)

(73) Assignee: Zhonghuan Advanced Semiconductor Technology Co., Ltd., Jiangsu (CN)

( * ) Notice: Subject to any disclaimer, the term of this patent is extended or adjusted under 35 U.S.C. 154(b) by 207 days.

(21) Appl. No.: 17/192,918

(22) Filed: Mar. 5, 2021

(65) Prior Publication Data

US 2021/0276150 A1 Sep. 9, 2021

(30) Foreign Application Priority Data

Mar. 6, 2020 (CN) ..... 202010152622.1

(51) Int. Cl.
*B24B 57/02* (2006.01)
*B24B 37/005* (2012.01)
*B24B 37/08* (2012.01)

(52) U.S. Cl.
CPC ..... *B24B 57/02* (2013.01); *B24B 37/005* (2013.01); *B24B 37/08* (2013.01)

(58) Field of Classification Search
CPC ..... B24B 53/095; B24B 55/02; B24B 49/08; B24B 49/186; B24B 53/007; B24B 57/02; B24B 57/00; B24B 37/005; B24B 37/08; B24B 37/04; B24B 37/042; B24B 37/10; B24B 37/28; B24B 37/34; B24B 1/00; B24B 7/228
USPC ..... 451/449, 450, 5, 8, 10, 11, 36, 37, 41, 451/261, 262, 283, 285, 287, 288, 290
See application file for complete search history.

(56) References Cited

U.S. PATENT DOCUMENTS 6,672,943 B2 * 1/2004 Vogtmann ..... B24D 7/06 451/259
7,666,064 B2 * 2/2010 Junge ..... B24B 55/02 451/21

FOREIGN PATENT DOCUMENTS

CN 104669105 A 6/2015
CN 106466808 A 3/2017

OTHER PUBLICATIONS

Texas Instruments, What it Takes to do Efficient and Cost-Effective Real-Time Control with a Single Microcontroller: The C2000™ Advantage (Year: 2011).*

(Continued)

*Primary Examiner* — Steven M Cernoch
*Assistant Examiner* — Steven Huang
(74) *Attorney, Agent, or Firm* — Samson G. Yu

(57) ABSTRACT

A control method of a grinding water flow rate during a double side grinding process. A double side grinder used includes a grinding wheel, a feed unit and a water supply device, wherein a water inlet is disposed on the feed unit. The control method includes: prepare for grinding and complete the installation of a workpiece according to an operation procedure of the double side grinder; during a process of double side grinding, the flow rate of the water inlet is set to decrease with the shortening of the teeth length of the grinding wheel, with the flow rate of the water inlet being set to have a linear relationship with the teeth length of the grinding wheel.

4 Claims, 2 Drawing Sheets

(56) References Cited

OTHER PUBLICATIONS

Linear Interpolation, Wikipedia (Year: 2018).*
Linear Definition (Year: 2022).*

* cited by examiner

CONTROL METHOD OF GRINDING WATER FLOW RATE DURING DOUBLE SIDE GRINDING PROCESS

CROSS-REFERENCE TO RELATED APPLICATION(S)

The present application claims priority to Chinese Patent Application No. 202010152622.1, filed on Mar. 6, 2020 and entitled "Control Method of Grinding Water Flow Rate During Double Side Grinding Process", the contents of which are herein incorporated in its entirety by reference.

TECHNICAL FIELD

The present disclosure relates to a field of double side grinding, and specially, relates to a control method of a grinding water flow rate during a double side grinding process.

BACKGROUND

The principle of double side grinding process is while a workpiece rotates axially in a vertical direction, the grinding wheels having grinding wheel teeth which are disposed symmetrically grind the damaged layers on both sides of the workpiece, so as to achieve the double side grinding effect. Multi-wire sawing process causes a highly damaged surface with waved shapes, double side grinding is significant step applied after multiple wire cutting to make a flat surface in required geometry, remove thickness variation through the wafers and remove double side damages to minimize polishing time.

Currently, the grinding water is used for washing away silicon during the double side grinding process. Nevertheless, the flow rate of grinding water always keep the same setting during the actual grinding process. Actually, the teeth length of grinding wheel is always changed. If the grinding water flow rate is too small during the teeth length of the grinding wheel is too long, the grinding silicon cannot be removed in time and it will caused the serious abrasion of the grinding wheels. On the contrary, if the grinding water flow rate is too large during the teeth length of the grinding wheel is too short, the water will not be drained in time to be accumulated between the grinding wheels and the workpiece. The water will cause the workpiece variation, and it will impact the surface quality of the workpiece and waste the water usage. It's not a small cost for long term.

Therefore, the control method of the grinding water flow rate can be improved in the prior art for double side grinding process.

SUMMARY

The present disclosure aims will solve one of the technical problems in the prior art at least. Therefore, the object of the present disclosure is to provide a control method of a grinding water flow rate during the double side grinding process. The method is to control the water flow rate of the feed unit inlet, and the water flow rate will be decreased during the teeth length of grinding wheel reducing. The water flow rate has a linear relationship with the teeth length of the grinding wheel, and it will optimize the process condition. The advantage includes to remove grinding silicon between a workpiece and a grinding wheel in time and avoid the water is accumulated to cause the workpiece variation. The most important thing is it will reduce the grinding resistance between the grinding wheel teeth and the workpiece, then prolong the wheel life of the grinding wheels.

In one aspect of the present disclosure, the present disclosure provides a control method of a grinding water flow rate during the double side grinding process. According to some embodiments of the present disclosure, a double side grinder includes a grinding wheel, a feed unit and a water supply device, a water inlet being adapted on the feed unit, the control method including:

S001: according to the operation procedure of the double side grinder, prepare for grinding and complete the installation and debugging of the workpiece;

S002: in the process of double side grinding, the flow rate of the water inlet is set to decrease with the shortening of the teeth length of the grinding wheel, and the flow rate of the water inlet is set to have a linear relationship with the teeth length of the grinding wheel.

In the double side grinding process, the grinding water is used to take away the silicon formed during grinding. However, if the grinding water flow rate is too small, the silicon powder in the grinding part of the workpiece will not be taken away, and the silicon powder will be accumulated between the grinding wheel and the workpiece, which will cause too much grinding resistance to the workpiece, and reduce the wheel life of the grinding wheel, thus affecting the stability of the grinding process; on the contrary, if the grinding water flow rate is too large, although the silicon powder in the grinding part of the workpiece can be taken away normally, the excess water can not be drained. However, in the actual grinding process, the teeth length of the grinding wheel will gradually decrease. In the prior art, the flow rate of grinding water is set a constant value. In the production process, when the wheel teeth length is less than 1.5 mm, the spacing is small between the wheel teeth and the workpiece, If the water flow rate is too large, it is difficult to drain water and it will directly cause the external force on the workpiece, which is easy to deflect the workpiece and have the uneven grinding.

The inventor of the invention has just realized the above problems, Through a lot of practice, it is found that in the process of double side grinding, the flow rate of the water inlet on the feed unit is set to decrease with the shortening of the teeth length of the grinding wheel, and the flow rate of the water inlet is set to have a linear relationship with the grinding wheel teeth length, i.e., according to the linear relationship between the grinding water flow rate and the grinding wheel teeth length, the grinding water can be adjusted in real time, which can not only remove the grinding silicon between the workpiece and the grinding wheel in time, avoiding the change of grinding capability to cause the accumulation of the grinding silicon, improving, the surface quality of the workpiece, but also can reduce the grinding resistance between the grinding wheel teeth and the workpiece, prolonging the service life of the grinding wheel.

In addition, the control method of the grinding water flow rate during the double side grinding process according to some embodiments of the present disclosure may further have the following additional technical features:

In some embodiments of the present disclosure, the functional relationship between the teeth length of the grinding wheel and, the flow rate of the water inlet is:

$$Q = \frac{(K-P)X}{Xm} + P,$$

wherein Q is the water flow rate of the water inlet at a single side, and the unit is Litres/minute; K is the minimum set water quantity when the teeth length of the grinding wheel is the longest, and the unit is Litres/minute; P is the minimum set water quantity when the teeth length of the grinding wheel is the shortest, and the unit is Litres/minute; Xm is the maximum teeth length of the grinding wheel, and the unit is mm; and X is the teeth length of the grinding wheel, and the unit is mm.

In some embodiments of the present disclosure, the functional relationship between the teeth length of the grinding wheel and the flow rate of the water inlet is:

$$Q = \frac{(K-P)X}{Xm} + P,$$

the value of K is related to D, Xm and C, and the value of P is related to D, Xn and C, wherein D is the spacing between the adjacent grinding wheel teeth, and the unit is mm; Xn is the minimum teeth length of the grinding wheel, and the unit is mm; and C is a constant determined by the material and structure of the grinding wheel teeth themselves.

In some embodiments of the present disclosure, the functional relationship between the teeth length, of the grinding wheel and the flow rate of the water inlet is:

$$Q = \frac{(K-P)X}{Xm} + P,$$

wherein the value of K is directly proportional to D*Xm*C, and the value of P is directly proportional to D*Xn*C.

In some embodiments of the present disclosure, the teeth length X of the grinding wheel is from 0.1 mm to 6 mm.

In some embodiments of the present disclosure, the grinding wheel teeth are distributed at intervals, and the spacing D between two adjacent grinding wheel teeth is from 0.5 mm to 2 mm.

In some, embodiments of the present disclosure, the control method of the grinding water flow rate further includes: S003: during a grinding process of the workpiece, monitoring the teeth length of the grinding wheel in real time by a length measurement mechanism, and transmitting the teeth length X of the grinding wheel to a controller.

In some embodiments of the present disclosure, the control method of the grinding water flow rate further include S004: receiving feedback from the controller by a water quantity control mechanism, and adjusting the water flow rate Q in real time.

Some of the additional aspects and advantages of some embodiment s of the present disclosure will be given in the following description, and the remaining will become apparent from the following description, or be learned from the practice of some embodiments of the present disclosure.

DETAILED DESCRIPTION OF THE EMBODIMENTS

The embodiments described below are exemplary, and are intended to explain the present disclosure and cannot be construed as limitation to the present disclosure.

In the prior art the flow rate of grinding water is set a constant value. However, in the actual grinding process, the teeth length of the grinding wheel will gradually decrease. If the grinding water flow rate is too small, it will cause too much grinding resistance to the workpiece, and reduce the wheel life of the grinding wheel. on the contrary, if the grinding water flow rate is too large, the excess water can not be drained and it will be accumulated between the grinding wheel and the workpiece, It will directly cause the external force on the workpiece, In the production process, when the wheel teeth length is less than 1.5 mm, the spacing is small between the wheel teeth and the workpiece, If the water flow is too large, it is difficult to drain water and it will directly cause the external force on the workpiece, which is easy to deflect the workpiece and have the uneven grinding.

In order to solve the described problems, crucially, a water flow rate at the grinding positions needs to be maintained stability. When the water flow rate is stable at the grinding positions, the water can easily reach the grinding positions at a water inlet, and the water can be easily drained at the grinding positions. It will help to stabilize the grinding resistance, keep the grinding stability and remove the grinding silicon in time.

Figure 1:
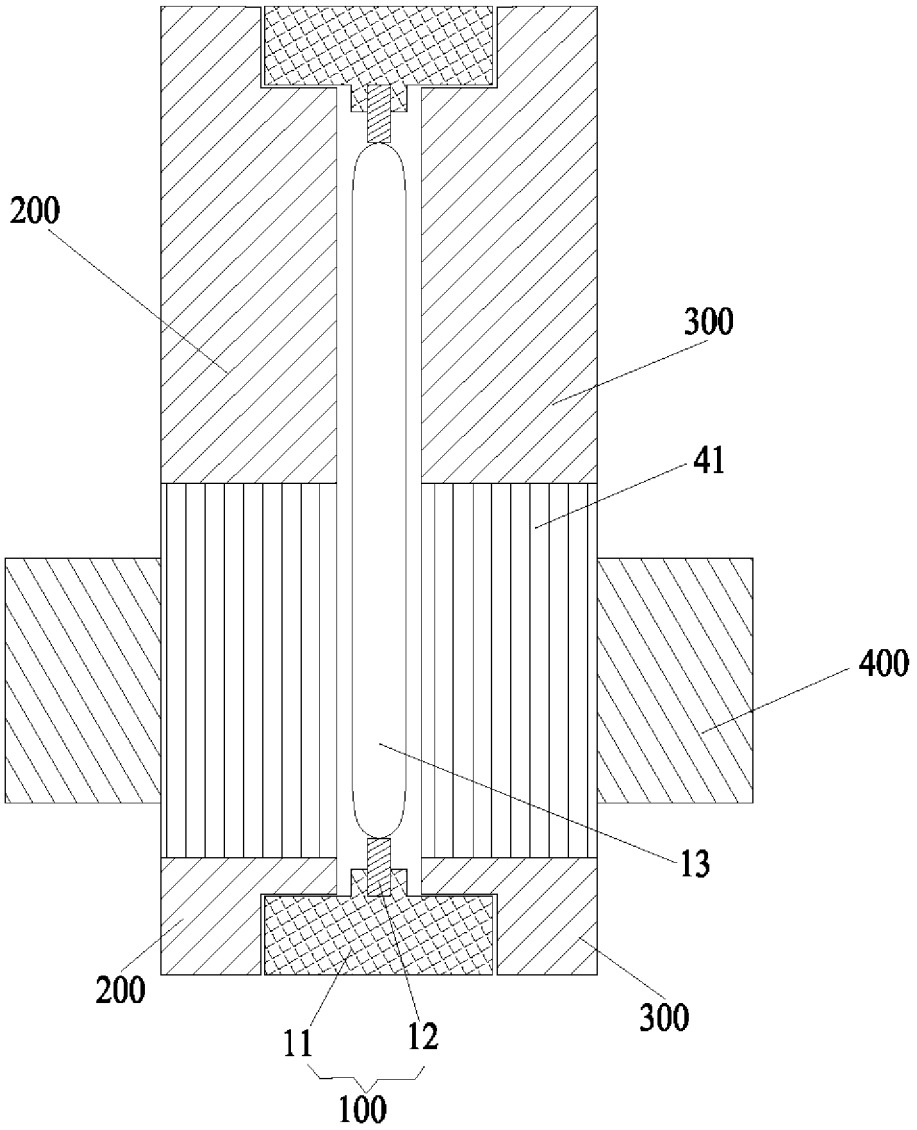
FIG. 1 is a longitudinal sectional structural diagram of a grinder used in the control method of the grinding water flow rate for double side grinding according to some embodiments of the present disclosure.

In order to achieve a stability of water flow rate at the grinding position, through a lot of research, regarding different tooth shapes and spacing of adjacent grinding wheel teeth, the invention studies a control method of a grinding water flow rate during the double side grinding process. The method includes: S001: according to the operation procedure of double side grinding, prepare for grinding and complete the installation and debugging of workpiece;

The double side grinder using the control method can be a model DXSG3200 double side grinder on the market or a double side grinder of a similar structure (see FIG. 1 for details). In the double side grinder, the workpiece rotates axially in a vertical direction, and a damaged layer of the workpiece is ground by grinding wheel teeth on the grinding wheels which are symmetrically adapted at both sides of the grinder, so as to achieve the double side grinding.

Figure 2:
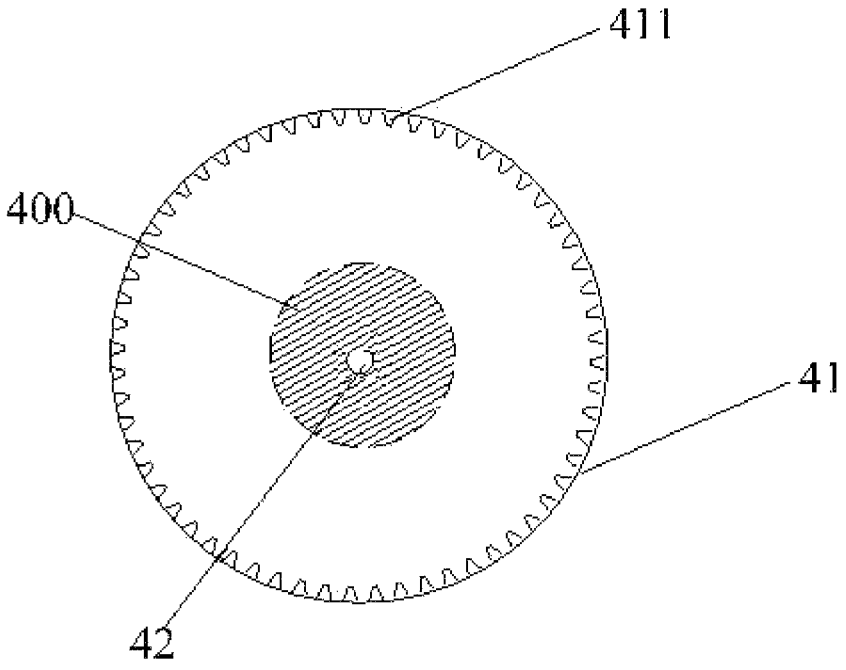
FIG. 2 is a left view of a grinding wheel at the right side of the grinder used in the control method of the grinding water flow rate for double side grinding according to some embodiments of the present disclosure.

Specifically referring to FIG. 1, the double side grinder includes a carrier holder 100, a first hydrostatic pad 200, a second hydrostatic pad 300, and a feed unit 400 with grinding wheels 41. The carrier holder 100 includes a hydrostatic carrier 11 and a stainless carrier ring 12, the stainless carrier ring 12 supports the peripheral side of a workpiece 13 in a radial direction, the stainless carrier ring 12 drives the workpiece 13 to rotate axially in a vertical direction, and the hydrostatic carrier 11 is fixedly disposed on the peripheral side of the stainless carrier ring 12 in the radial direction; the first hydrostatic pad 200 and the second hydrostatic pad 300 are symmetrically arranged at two sides of the carrier holder 100; and while the feed unit 400 move along the axial direction, the grinding wheels 41 on the feed unit 400 directly grind the workpiece 13 through the holes, which are set in the lower parts of the first hydrostatic pad 200 and the second hydrostatic pad 300. Also referring to FIG. 2, a penetrating water inlet 42 is adapted on the feed unit 400, and grinding water can be supplied to the surface of each of grinding wheels 41 having grinding wheel teeth through the water inlet 42. In addition, the double side grinder further includes a water supply device (not shown) for supplying water, and the water supply device is connected with the water inlet 42. It should be noted that the driving type of the stainless carrier ring 12 in some embodiments of the present disclosure is not limited, as long as it can realize that the stainless carrier ring 12 is rotated in the vertical direction.

Further, the spacing between adjacent grinding wheel teeth 411 on the surface of grinding wheels 41 is from 0.5 mm to 2 mm, and the preparation work before grinding includes: installing the workpiece 13, adjusting the distance between the first hydrostatic pad 100 and the second hydrostatic pad 200, setting the rotational speed of the workpiece 13, adjusting the positions and rotational speeds of the grinding wheels 41, connecting to the water supply device, etc.

S002: in the process of double side grinding, the flow rate of the water inlet is set to decrease with the shortening of the teeth length of the grinding wheel, and the flow rate of the water inlet is set to have a linear relationship with the teeth length of the grinding wheel.

By means of the water flow rate control method in some embodiments of the present disclosure, the silicon powder can be taken away between the workpiece and the grinding wheels, avoiding the change of grinding capability to cause the accumulation of the grinding silicon, improving the surface quality of the workpiece, but also can reduce the grinding resistance between the grinding wheel teeth and the workpiece, prolonging the service life of the grinding wheel.

In order to further confirm the functional relationship between the flow rate Q of the grinding water at a single side of the grinding wheel and the teeth length X of the grinding wheel, by means of a lot of experimental studies again, it has been found that the functional relationship between the flow rate Q of the water inlet at a single side of the grinding wheel and the teeth length X of the grinding wheel is:

$$Q = \frac{(K-P)X}{Xm} + P,$$

wherein Q is the water flow rate of the water inlet at a single side, and the unit is Litres/minute; K is the minimum set water quantity when the teeth length of the grinding wheel is the longest, and the unit is Litres/minute; is the minimum set water quantity when the teeth length of the grinding wheel is the shortest, and the unit is Litres/minute; Xm is the maximum teeth length of the grinding wheel, and the unit is mm; and X is the teeth length of the grinding wheel, and the unit is mm.

Preferably, the value of K is related to D, Xm and C, and the value of P is related to D, Xn and C, wherein D is the spacing between the adjacent grinding wheel teeth, and the unit is mm; Xn is the minimum teeth length of the grinding wheel, and the unit is mm; and the value of C is a constant determined by the material and structure of the grinding wheel teeth themselves. For a grinding wheel, the value of C is definitely constant.

Preferably, the value of K is directly proportional to D*Xm*C, and the value of P is directly proportional to D*Xn*C.

Moreover, during the double side grinding process on the workpiece, the water supply device is connected with a water quantity control mechanism, that is, according to the functional relationship between the teeth length X of grinding wheel on the grinding wheels and the flow rate Q of the water inlet, the water quantity control mechanism adjusts the flow rate of the water inlet in real time, so as to remove grinding silicon between the workpiece and the grinding wheels in time.

Further, the teeth length X of the grinding wheel is monitored in real time by means of a length measurement mechanism, which is transmitted to a controller. Specifically, the length measurement mechanism monitors the teeth length of the grinding wheel by monitoring changes of the position of the feed unit and the thickness of the workpiece; and a grinding wheel feed mechanism records the position of the feed unit in real time. Since the grinding wheel is mounted on the feed unit, the position of the grinding wheel can be corresponding obtained. In addition, while a thickness gauge is used to record the grinding thickness Δ D of the workpiece; then on the basis of the position change of the feed unit, i.e., the position change ΔS of the grinding wheel and the grinding thickness ΔD of the workpiece, the change of the grinding wheel teeth length Δ X, i.e., Δ X=Δ S−Δ D/2, is obtained; and then according to the initial teeth length Xm of the grinding wheel, the teeth length X of the grinding wheel, i.e., X=Xm−(ΔS−Δ D/2) can be obtained during the grinding process, wherein the units of Xm, ΔS and ΔD are all mm. Therefore the initial position and the initial teeth length of the grinding wheel need to be repositioned each time when the grinding wheel is replaced.

Furthermore, while the controller receives the information of teeth length X of the grinding wheel fed back by the length measurement mechanism, the controller calculates the water flow rate Q according to the set functional relationship between the teeth length of the grinding wheel and the water flow rate of the water inlet at a single side of the grinding wheel. As soon as the information of the water flow rate Q is fed back to the water quantity control mechanism, the water quantity control mechanism receives the feedback from the controller, then controls the water supply device and adjusts the water flow rate Q at a single side of the grinding wheel in real time, thereby removing silicon powder between the workpiece and the grinding wheels in time.

It should be noted that in some embodiments of the present disclosure, "controller", "length measurement mechanism" and "water quantity control mechanism" are all existing components or software, and a person skilled in the art would have been able to make a selection according to actual needs as long as they can achieve the described functions, and thus they will not be repeated here.

Thus, in the control method, of the grinding water flow rate during double side grinding process in some embodiments of the present disclosure, the flow rate Q of the water inlet on a single side on the feed unit and the teeth length X of the grinding wheel on the grinding wheels are adjusted according to $$Q = \frac{(K-P)X}{Xm} + P,$$

which not only can remove silicon powder between the workpiece and the grinding wheels in time, avoiding the change of grinding capability to cause the accumulation of the grinding silicon, improving the surface quality of the workpiece, but also can reduce the grinding resistance between the grinding wheel teeth and the workpiece, prolonging the service life of the grinding wheel.

Hereinafter, some embodiments of the present disclosure are described, taking silicon wafer as an example. It should be noted that these embodiments are merely illustrative, and do not limit the present disclosure in any way.

Embodiment 1

During the double side grinding process, grinding wheels of which the spacing between the adjacent grinding wheel teeth is 0.5 mm are used.

First, before grinding, the values of K and P are preset, i.e., when Xm=0 mm, K=1.3 L/min, P=0.8 L/min, and Xn=0.1 mm, and the functional relationship between the flow rate Q of the water inlet at a single side of the grinding wheel and the teeth length X of the grinding wheel is:

$$Q = \frac{(K-P)X}{Xm} + P = \left((1.3-0.8)/6\right)^{*}X + 0.8.$$

According to this functional formula, the controller obtains the flow rate Q of the water inlet at a single side of the grinding wheel as receiving the teeth length of the grinding wheel in real time, and after receiving a Q value fed back from the controller, the water quantity control mechanism controls the water supply device to adjust the water flow rate in real time.

When the length measurement mechanism measures that the teeth length of the grinding wheel is 0.1 mm, the controller receives this information and stops the operation, then the grinding wheels are replaced. During the grinding process, the total number of silicon wafers processed is 4,500.

Comparative Embodiment 1

During the double side grinding process, the same grinding wheels as those in Embodiment 1 are used, the flow rate Q of the water inlet at a single side of the grinding wheel is constant at 0.0 L/min, and the grinding wheels are replaced when Xn=0.1 mm, and during the grinding process, the total number of silicon wafers processed is 2,100.

Embodiment 2

During the double side grinding process, grinding wheels of which the spacing between the adjacent grinding wheel teeth is 1 mm are used.

First, before grinding, the values of K and P are preset, i.e., when Xm=6 mm, K=2.8 L/min, P=1.0 L/min, and Xn=0.1 mm, and the functional relationship between the flow rate Q of the water inlet at a single side of the grinding wheel and the teeth length X of the grinding wheel is:

$$Q = \frac{(K-P)X}{Xm} + P = \left((2.8-1)/6\right)^{*}X + 1.$$

According to this functional formula, the controller obtains the flow rate C of the water inlet at a single side of the grinding wheel as receiving the teeth length of the grinding wheel in real time, and after receiving a 0 value fed back by the controller, the water quantity control mechanism controls the water supply device to adjust the water flow rate in real time.

When the length measurement mechanism measures that the teeth length of the grinding wheel is 0.1 mm, the controller receives this information and stops the operation, then the grinding wheels are replaced. During the grinding process, the total number of silicon wafers processed is 4600.

Comparative Embodiment 2

During the double side grinding process, the same grinding wheels as those in Embodiment 2 are used, the flow rate Q of the water inlet at a single side of the grinding wheel is constant at 1.0 L/min, and the grinding wheels are replaced when Xn=0.1 mm, and during the grinding process, the number of silicon wafers processed is 2,200.

Embodiment 3

During the double side grinding process, grinding wheels of which the spacing between the adjacent grinding wheel teeth is 1.5 mm are used.

First, before grinding, the values of K and P are preset, i.e., when Xm=5 mm, K=8 L/min, P=1.5 L/min and Xn=0.1 mm, and the functional relationship between the flow rate Q of the water inlet at a single side of the grinding wheel and the teeth length X of the grinding wheel is $$Q = \frac{(K-P)X}{Xm} + P = \left((3-1.5)/5\right)^{*}X + 1.5.$$

According to this functional formula, the controller obtains the flow rate Q of the water inlet at a single side of the grinding wheel as receiving the teeth length of the grinding wheel in real time, and after receiving a 0 value fed back by the controller, the water quantity control mechanism controls the water supply device to adjust the water flow rate in real time.

When the length measurement mechanism measures that the teeth length of the grinding wheel is 0.1 mm, the controller receives this information and stops the operation, then the grinding wheels are replaced. During the grinding process, the total number of silicon wafers processed is 4,700.

Comparative Embodiment 3

During the double side grinding process, the same grinding wheels as those in Embodiment 3 are used, the flow rate Q of the water inlet at a single side of the grinding wheel is constant at 1.5 L/min, and the grinding wheels are replaced when Xn=0.1 mm, and during the grinding process, the total number of silicon wafers processed is 2,300.

Embodiment 4

During the double side grinding process, grinding wheels of which the spacing between the adjacent grinding wheel teeth is 2 mm are used.

First, before grinding, the values of K and P are preset, i.e., when Xm=5 mm, K=4 L/min, P=1.8 L/min and Xn=0.1 mm, and the functional relationship between the flow rate Q of the water inlet on a single side of the grinding wheel and the teeth length X of the grinding wheel is:

$$Q = \frac{(K-P)X}{Xm} + P = \left((4-1.8)/5\right)^{*}X + 1.8.$$

According to this functional formula, the controller obtains the flow rate Q of the water inlet at a single side of the grinding wheel as receiving the teeth length of the grinding wheel in real time, and after receiving a Q value fed back by the controller, the water quantity control mechanism controls the water supply device to adjust the water flow rate in real time.

When the length measurement mechanism measures that the teeth length of the grinding wheel is 0.1 mm, the controller receives this information and stops the operation, then the grinding wheels are replaced. During the grinding process, the total number of silicon wafers processed is 4,800.

Comparative Embodiment 4

During the double side grinding process, the same grinding wheels as those in Embodiment 4 are used, the flow rate Q of grinding water at a single side of the grinding wheel is constant at 1.8 L/min, and the grinding wheels are replaced when Xn=0.1 mm, and during the grinding process, the total number of silicon wafers processed is 2,400.

In conclusion, comparing Embodiments 1-4 and Comparison Embodiments 1-4, it has been found that by using the water flow rate control method in some embodiments of the present disclosure, the same grinding wheels can process a larger number of silicon wafers, and obviously, the control method using in some embodiments of the present disclosure prolongs the service life of the grinding wheels and reduces the production costs.

The data of corresponding grinding mark reject ratios of the thinned silicon wafers in Embodiments 1-4 and Comparative Embodiments 1-4 are shown in Table 1. The grinding mark reject ratio is a ratio of yield loss caused by the fact that a surface damaged layer formed during a grinding process is too thick and cannot be removed in a subsequent process. It can be determined from the data in Table 1 that under the same conditions in other aspects (grinding wheels and grinding rates, etc.), the grinding mark reject ratio of silicon wafers produced by using the water flow rate control method in some embodiments of the present disclosure is relatively low, improving the quality and yield of the product.

TABLE 1

| Embodiment/ Comparative Embodiment | Grinding mark reject ratio | TTV (unit: μm) |
|---|---|---|
| Embodiment 1 | 0.14% | 0.55 |
| Embodiment 2 | 0.12% | 0.54 |
| Embodiment 3 | 0.10% | 0.55 |
| Embodiment 4 | 0.11% | 0.56 |
| Comparative Embodiment 1 | 0.29% | 0.58 |
| Comparative Embodiment 2 | 0.35% | 0.59 |
| Comparative Embodiment 3 | 0.21% | 0.58 |
| Comparative Embodiment 4 | 0.26% | 0.60 |

The total thickness variation (TTV) values of the silicon wafers produced in Embodiments 1-4 and Comparative Embodiments 1-4 are shown in Table 1, and it has been found that the total thickness variation (TTV) values have a very small difference. In practical production, in order to make the TTV meet the requirements, the machine needed to be debugged. The method using the water flow rate control method in some embodiments of the present disclosure, a small amount of the abrasion loss of the grinding wheels, a small change in the grinding wheel teeth length, apparently prolongs the service life of grinding wheels, so that the low frequency adjustment of grinding wheels. However, the method using a constant water flow rate, a great amount of the abrasion loss of the grinding wheels, the large change in the grinding wheel teeth length, apparently reduces the service life of grinding wheels, so that the relatively high frequency adjustment of the grinding wheels. The high frequency adjustment of grinding wheels will cause a relatively high grinding mark reject ratio, which has been shown in the data in Table 1.

In the illustration of the present description, the illustration of reference terms "an embodiment", "some embodiments", "an example", "a specific example" or "some examples", etc. means that specific features, structures, materials or characteristics described in connection with the embodiment or example are comprised in at least one embodiment or example in the present disclosure. In the present description, the illustrative expressions of the described terms are not necessarily regarding the same embodiment or example. Furthermore, the specific features, structures, materials, or characteristics described may be combined in any suitable manner in one or more embodiments or examples. In addition, a person skilled in the art could combine different embodiments or examples and the features in different embodiments or examples described in the present description without conflicting with each other.

Although some embodiments of the present disclosure have been shown and described above, it would be appreciated that the described embodiments are illustrative and cannot be understood as limiting the present disclosure, and a person of ordinary skill in the art could make variations, modifications, substitutions and variants in the described embodiments within the scope of the present disclosure.

What is claimed is:

1. A control method of a grinding water flow rate during a double side grinding process, wherein a double side grinder used comprises a grinding wheel, a feed unit and a water supply device, a water inlet being provided on the feed unit, the control method comprising:

preparing for grinding and completing an installation of a workpiece according to an operation procedure of the double side grinder;

during a process of double side grinding, setting a flow rate of the water inlet to decrease with a shortening of a teeth length of the grinding wheel, with the flow rate of the water inlet being set to have a linear relationship with the teeth length of the grinding wheel;

wherein a functional relationship between the teeth length of the grinding wheel and the flow rate of the water inlet is:

$$Q = \frac{(K-P)X}{Xm} + P,$$

wherein:

Q is the flow rate of the water inlet at a single side, and a unit is Litres/minute;

K is a minimum set water quantity when the teeth length of the grinding wheel is at a maximum teeth length, and a unit is Litres/minute;

P is a minimum set water quantity when the teeth length of the grinding wheel is at a minimum teeth length, and a unit is Litres/minute;

Xm is the maximum teeth length of the grinding wheel, and a unit is mm; and

X is the teeth length of the grinding wheel, and a unit is mm;

wherein the teeth length X of the grinding wheel is from 0.1 mm to 6 mm;

the water flow rate control method further comprises: monitoring the teeth length of the grinding wheel in real time during a grinding process of the workpiece and transmitting the teeth length X of the grinding wheel to a controller, wherein the teeth length X of the grinding wheel during the grinding process satisfies: $X=Xm-(S-M/2)$, wherein:

S is a position change of the grinding wheel, and a unit is mm;

M is a grinding thickness of the workpiece, and a unit is mm.

2. The control method of the grinding water flow rate as claimed in claim 1, wherein a value of K is related to D, Xm and C, and a value of P is related to D, Xn and C, wherein D is a spacing between adjacent grinding wheel teeth, and a unit is mm;

Xn is the minimum teeth length of the grinding wheel, and a unit is mm; and and C is a constant determined by a material and structure of grinding wheel teeth themselves.

3. The control method of the grinding water flow rate as claimed in claim 2, wherein the value of K is directly proportional to D*Xm*C, and the value of P is directly proportional to D*Xn*C.

4. The control method of the grinding water flow rate as claimed in claim 2, wherein the grinding wheel teeth are distributed at intervals, and the spacing D between the adjacent grinding wheel teeth is 0.5 mm to 2 mm.

* * * * *